US006512495B1

(12) United States Patent
Ragland

(10) Patent No.: US 6,512,495 B1
(45) Date of Patent: Jan. 28, 2003

(54) CONCAVE REFLECTOR WITH PHASE SHIFTED AND SELECTIVELY FOCUSED OUTPUT ENERGY

(75) Inventor: Richard R. Ragland, Carlsbad, CA (US)

(73) Assignee: QUALCOMM, Inc., San Diego, CA (US)

( * ) Notice: Subject to any disclaimer, the term of this patent is extended or adjusted under 35 U.S.C. 154(b) by 0 days.

(21) Appl. No.: 09/941,316

(22) Filed: Aug. 28, 2001

(51) Int. Cl.[7] ..... H01Q 15/14
(52) U.S. Cl. ..... 343/912; 343/840
(58) Field of Search ..... 343/912, 840, 343/786, 781 R

(56) References Cited

U.S. PATENT DOCUMENTS 4,801,946 A * 1/1989 Matz, Jr. ..... 343/840

* cited by examiner

*Primary Examiner*—Don Wong
*Assistant Examiner*—James Clinger
(74) *Attorney, Agent, or Firm*—Philip R. Wadsworth; Gregory D. Ogrod; Thomas M. Thibault

(57) ABSTRACT

A concave reflector is shaped to receive energy emanating from a signal source positioned at the reflector's vertex and to reflect all received energy in a uniform output direction. The reflector additionally introduces a designated constant phase shift into all reflected energy relative to unreflected energy from the signal source, regardless of where the received energy impinges upon the reflector. When the source signal is periodic, this reflector design minimizes near field interference between the reflected signals, since they all have the same phase shift relative to the unreflected source signal. Furthermore, if the reflector is designed to implement zero phase shift, reflected and non-reflected signals tend to combine additively in the far field, focusing most of the transmitted energy toward the center of the transmission pattern. In addition to this reflector apparatus, other features include a process of manufacturing a signal reflector, a product formed by this manufacturing process, and beam shaping process incorporating these principles.

16 Claims, 3 Drawing Sheets

MANUFACTURE & OPERATION

CONCAVE REFLECTOR WITH PHASE SHIFTED AND SELECTIVELY FOCUSED OUTPUT ENERGY

BACKGROUND OF THE INVENTION

I. Field of the Invention

The present invention concerns reflectors for directing and concentrating energy from signal sources such as acoustic transducers. More particularly, this invention concerns a concave signal reflector that redirects energy from a signal source into a uniform output direction and provides all reflected signals with the same phase shift relative to unreflected signals from the energy source.

II. Description of the Related Art

There are many different types of signal reflectors. Signal reflectors have been designed for light energy (such as headlight beams), electromagnetic energy (such as microwave signals), sound energy (such as sonar signals), and many others. For the present discussion, without any intended limitation, "signal reflectors" may also be referred to as beam reflecting devices, parabolic reflectors, beam focusing elements, or other similar terms. Generally, a signal reflector is used in conjunction with a signal source, and serves to redirect energy from the signal source into an output beam of desired shape, divergence, strength, etc. One simple example of a signal reflector is a parabolic reflector positioned behind a light bulb in a flashlight.

Although many types of known signal reflector can be useful for certain purposes, none of these is completely satisfactory for the application of precisely directing acoustic signals in a confined area. This application often occurs, for example, in the business of QUALCOMM CORPORATION, which is the leading provider of fleet and freight management products through its OMNITRACS® and TRAILERTRACS® products and services. QUALCOMM INC. also has numerous other, unrelated businesses.

Broadly, the TRAILERTRACS product monitors various raw statistics concerning the state of freight vehicles, such as semi-tractor trailers. For instance, the TRAILERTRACS product can monitor trailer identification, geographical location, load/cargo status, refrigerator operation, fuel usage, engine properties, brake behavior, transmission activity, safety-related statistics, and other parameters. The TRAILERTRACS product also provides various analytical information, such as notifications or alarms that occur when a trailer is lost, there are too many or too few trailers at one location, there is an unauthorized trailer drop, the wrong trailer is connected to a truck, an unscheduled movement occurs, etc.

It is the load/cargo status sensing feature of TRAILERTRACS that creates a need to precisely direct acoustic signals in a confined area, namely the inside of a cargo trailer. However, as mentioned above, none of the known beam reflectors is completely satisfactory for this application. For instance, some known beam reflectors are too large, possibly interfering with cargo loading/unloading, being vulnerable to damage during loading/unloading, or merely occupying valuable space to the exclusion of cargo. Furthermore, as discovered by the present inventor(s), the beam pattern created by known reflectors is not particularly advantageous for use in acoustic cargo sensing applications. Namely, known acoustic reflectors tend to have a beam pattern with excessive peripheral energy and insufficient focal (central) energy. In the trailer environment, this results in transmission of acoustic signals in unwanted areas, such as the trailer's roof, floor, etc.

Another problem, first recognized by the present inventor herein, has been that many known reflectors redirect signals without regard for the haphazard introduction of phase shift into the reflected signal output. Namely, rays of the reflected signal incur various delays while they proceed out from the signal source and undergo redirection by the reflector. Consequently, the reflected signals may have varying phases relative to each other and to the unreflected signals. With many conventional signal reflector designs, phase shift is not a significant concern because the wavelength of the transmitted signals is relatively insignificant when compared to the physical dimensions of the reflective surface, or because the source signal is not periodic and the concept of phase shift is not applicable. Therefore, the prior art is unconcerned with the phase shift issue, and therefore does not address it.

Consequently, the known beam reflectors are not completely adequate for acoustic cargo sensing applications due to certain unsolved problems.

SUMMARY OF THE INVENTION

Broadly, the present invention concerns a concave reflector that receives some energy emanating from a signal source positioned substantially at the reflector's vertex. Other energy of the signal source exits the reflector directly without being reflected. The reflector is shaped to reflect all received energy in a predefined output direction, and comprises a shape such as a paraboloid. The shape of this reflector also introduces a designated constant phase shift into all reflected energy relative to unreflected energy from the signal source, regardless of where the received energy is received by the reflector. In addition to this reflector apparatus, other aspects of the invention include a process of manufacturing a signal reflector, a product formed by this manufacturing process, and beam shaping process incorporating these principles.

Unlike microwave and radio frequency signal reflectors, the invention takes the unusual approach of introducing selected phase shift into reflected signals. Such phase shift would not be tolerated, for example, in television or radio signals as it would scramble the ultimate output signal. However, this phase shift is perfect for applications using a repeating input signal.

The invention affords its users with a number of distinct advantages. Chiefly, the invention introduces a selected, uniform phase shift into all reflected signals. When the source signal is periodic, this design minimizes near field interference between the reflected signals, since they all have the same phase shift. Furthermore, if the reflector is. designed to implement a phase shift of zero (any multiple of 360 degrees), reflected and non-reflected signals tend to combine additively in the far field, focusing most of the transmitted energy toward the center of the transmission pattern. Near field in this case is the area inside and in front of the reflector, out to a distance roughly equivalent to $D^2/\lambda$, where D is the width dimension of the reflector's aperture and $\lambda$ is the wavelength of the transmitted signal. The far field is consequently defined as any area beyond or outside the near field.

The invention also provides a number of other advantages and benefits, which should be apparent from the following description of the invention.

DETAILED DESCRIPTION OF THE PREFERRED EMBODIMENTS

The nature, objectives, and advantages of the invention will become more apparent to those skilled in the art after considering the following detailed description in connection with the accompanying drawings.

HARDWARE COMPONENTS & INTERCONNECTIONS

One aspect of the invention concerns a signal reflector, and more particularly, a generally parabolic reflector shaped to receive some energy emanating from a signal source positioned substantially at a reflector's vertex, and to reflect all received energy in a predefined, uniform output direction. The shape of the reflector is also designed to introduce a designated constant phase shift into all rays of reflected energy relative to unreflected energy from the signal source regardless of where each different ray of received energy is received by the reflector.

Figure 1:
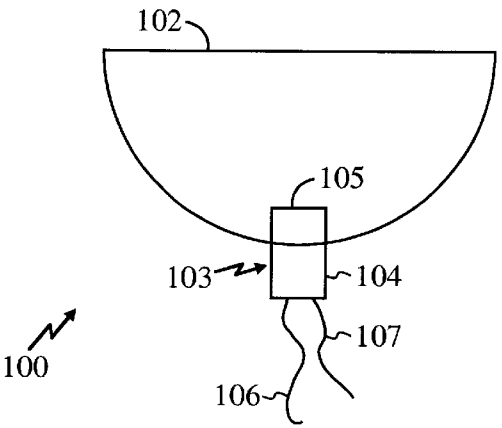
FIG. 1 is a side view of a concave reflector and signal source according to the invention.

This reflector may be embodied by various hardware components and interconnections, with one example being described in FIG. 1. More particularly, FIG. 1 shows a focused beam generator 100, which includes a signal reflector 102 and a signal source 103. The signal reflector 102 utilizes a concave shape which is similar or identical to a "paraboloid," namely, a three-dimensional shape formed by rotating a parabola about its axis. In other words, the reflector's cross-sectional shape is generally or identically parabolic. In this embodiment, the signal reflector 102 is symmetrical about a central axis, and its cross-sectional shape is generally or specifically parabolic.

At the reflector's vertex is positioned the signal source 103. The signal source 103 comprises a device for emanating energy, including but not limited to acoustic signals. In this embodiment, the source 103 comprises an acoustic transducer that utilizes a piezoelectric sound-generating element, of which there are numerous commercially available examples. Although there are particular benefits for use of this invention with for acoustic signals, and this example is used throughout this disclosure, the generator 100 may employ other signal sources to generate different energy, such as light, microwave signals, electromagnetic waves, etc.

Optionally, the signal source 103 includes a body, with a portion 104 residing outside the reflector 102 and a portion 105 residing inside the reflector 102. The relative portions inside and outside the reflector may be adjusted according to the particular application, type and design of the signal source, and other considerations. The portion 104 is attached to conductive leads 106–107 that carry electrical input signals to the signal generator's piezoelectric or other signal generating element.

Figure 2:
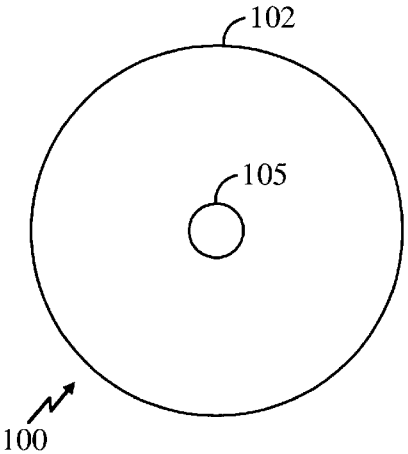
FIG. 2 is a top plan view of reflector and signal source according to the invention.
Figure 3:
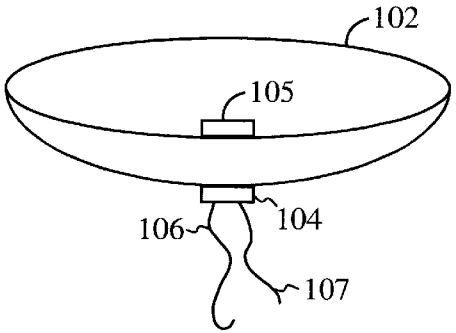
FIG. 3 is a perspective view of reflector and signal source according to the invention.
Figure 4:
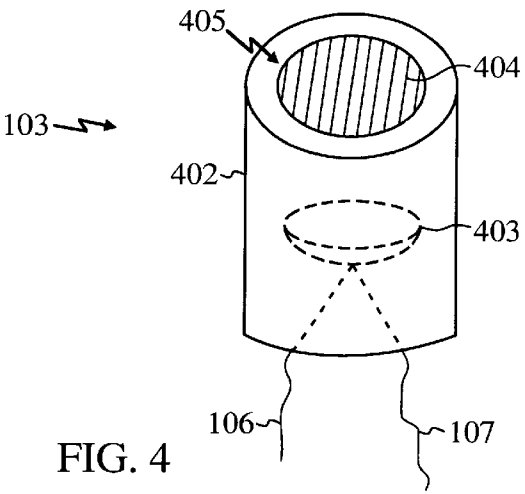
FIG. 4 is a perspective view of an exemplary signal source according to the invention.

FIG. 2 shows a different view of the focused beam generator 100, from the top. FIG. 3 shows still another view of the generator 100 in perspective. FIG. 4 illustrates, without any intended limitation, one exemplary signal source 103 in greater detail. The signal source 103 includes a generally cylindrical body 402 containing a piezoelectric element 406 coupled with a small horn 403. A mesh or similar screen 404 covers an opening 405 in the body, through which output signals generated by the piezoelectric element 406 exit the body 402. The horn 403 both gathers and pushes air molecules through the screen 404 in response to the vibrating piezoelectric element 406. The leads 106–107, coupled to the piezoelectric element 406, carry electrical input signals to the element 403 which cause the element 403 to vibrate, thereby, in concert with horn 403, converting said electrical signals into acoustic output signals.

Figure 6:
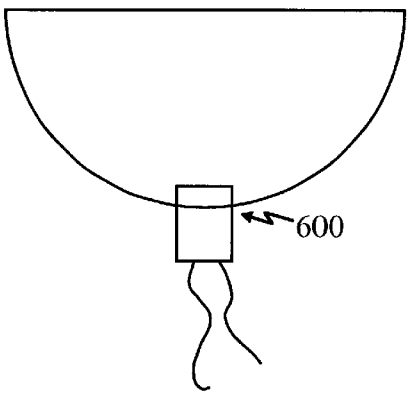
FIG. 6 is a side view of a reflector having a flattened apex, according to the invention.
Figure 5:
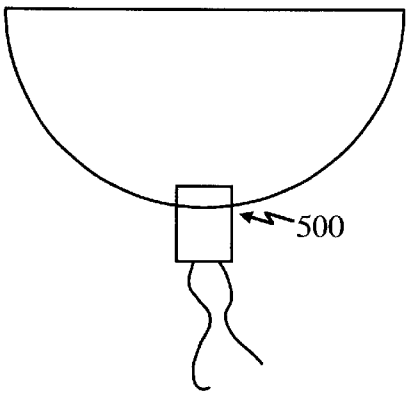
FIG. 5 is a side view of a reflector having a rounded apex, according to the invention.

FIG. 5 shows a reflector of the invention that is rounded at its vertex 500. In another embodiment (FIG. 6), the reflector may be flattened at its vertex 600. Flattening near the reflector's vertex may be possible without affecting the signal generator's output pattern, for example, if the signal source does not emanate any substantial energy rearward.

Figure 7:
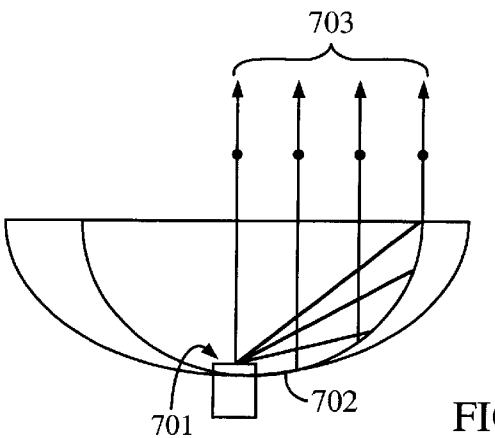
FIG. 7 is a cutaway side view of a reflector according to the invention, further illustrating the reflection of output energy emanating from a signal source.

FIG. 7 shows a cross-sectional view of a focused beam generator of the invention, highlighting various representative paths of the signal source's output energy. Specifically, energy emanates from the signal source at 701, impinges upon the reflector at various points 702, and then proceeds outward in a uniform, predetermined direction 703. The parallel nature of this output energy is beneficial in various ways, including helping to tightly focus the beam pattern. Other energy of the transducer proceeds directly outward of the reflector without impinging upon the reflector.

Figure 8:
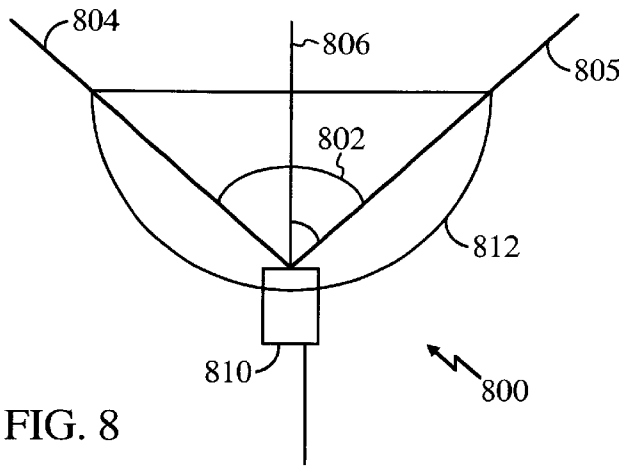
FIG. 8 is a cutaway side view of a reflector of the invention illustrating various reference angles.

FIG. 8 shows a schematic view of a beam generator 800 of this invention to further illustrate various reference angles. A signal source 810 is shown coupled to a reflector 812. The signal source 810 and reflector 812 share a common axis 806, about which signals from the source 810 emanate. Generally, the reflector 812 has a parabolic cross-section centered upon the axis 806. As dictated by the size and shape of the reflector 812, output signals do not contact the reflector 812 if they depart the signal source in the central angular region 802, namely between the angular limits 804–805. Output signals departing the signal source outside the central angular region 802 do contact the reflector 812, and experience redirection by the reflector. Due to the shape of the reflector 812, all reflected energy from the signal source 810 experiences redirection into the same, predetermined output direction (best shown by 703, FIG. 7). Output energy also experiences a predetermined phase shift; namely, all signals emanating from the signal source 810 undergo the same phase shift regardless of where they contact the reflector 812.

Figure 9:
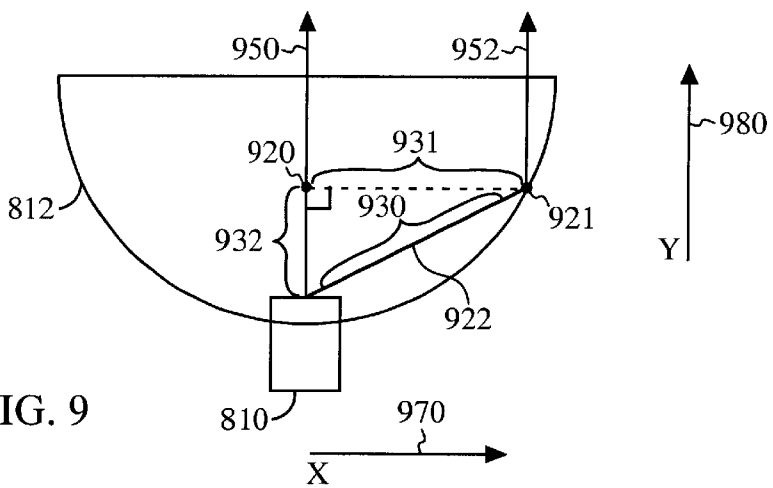
FIG. 9 is a side view schematic of a reflector of the invention illustrating the introduction of phase shift.

FIG. 9 illustrates the underlying physics in greater detail, utilizing the same signal source 810 and reflector 812 as FIG. 8. A "reference" ray 950 of energy emanates from the signal source 810 substantially along the axis (806, FIG. 8)

of the signal source and reflector. Unlike the reference ray, a divergent ray 922 exits the signal source outside the central angular range (802, FIG. 8), and therefore contacts the reflector 812 at 921. The reflector 812 reflects the ray 922 into substantially the same direction 952 as the reference ray 950. This holds true for all other reflected rays as well. The reason for this reflection into the same output direction is the angle that the reflector 812 makes to the incident ray 922 at point 921.

Importantly, the reflector 812 not only provides reflected rays with the common output direction (as discussed above), but also introduces a selected phase shift thereto. In particular, this is dictated by the shape of the reflector 812, and more particularly the distance that the reflector rises (in the "y" direction 980) for its progression outward (in the "x" direction 970). Even more particularly, the reflector 812 is designed to provide a predetermined difference in path length between (1) the distance 930 that the incident ray 922 travels before contacting the reflector 812 at point 921 and (2) the distance 932 that the reference ray 950 travels between the signal source 810 and a point 920 equivalent in "y" direction 980 to the point 921.

In other words, when the reference ray 950 reaches the point 920, it has traveled a distance 932. When the incident ray 922 reaches the point 921 (identical in its progress outward of the reflector in the "y" direction 980), it has traveled a greater distance 930, and therefore experienced a phase shift. As mentioned above, this phase shift is dictated by the shape of the reflector 812, and more particularly the amount that the reflector rises (in the "y" direction 980) for its progression outward (in the "x" direction 970). The reflector may be shaped, for example, to give a phase shift of 180 degrees, 360 degrees, 90 degrees, or any other amount. The phase shift introduced by the reflector 812 (in degrees) may be expressed as shown in Equation 1, below:

360 degrees*(distance 930−distance 932)/wavelength of the source signal [Equation 1]

Having described the structural features of the present invention, the operational aspect of the present invention will now be described. In particular, description is now made of the design and construction of a concave signal reflector according to this invention, and of its subsequent use to form a beam of selectively focused output energy. Although the present invention has broad applicability to different types of energy as mentioned above, the specifics of the structure that has been described is best suited for acoustic wave shaping, and the explanation that follows will emphasize such an application of the invention without any intended limitation.

Figure 10:
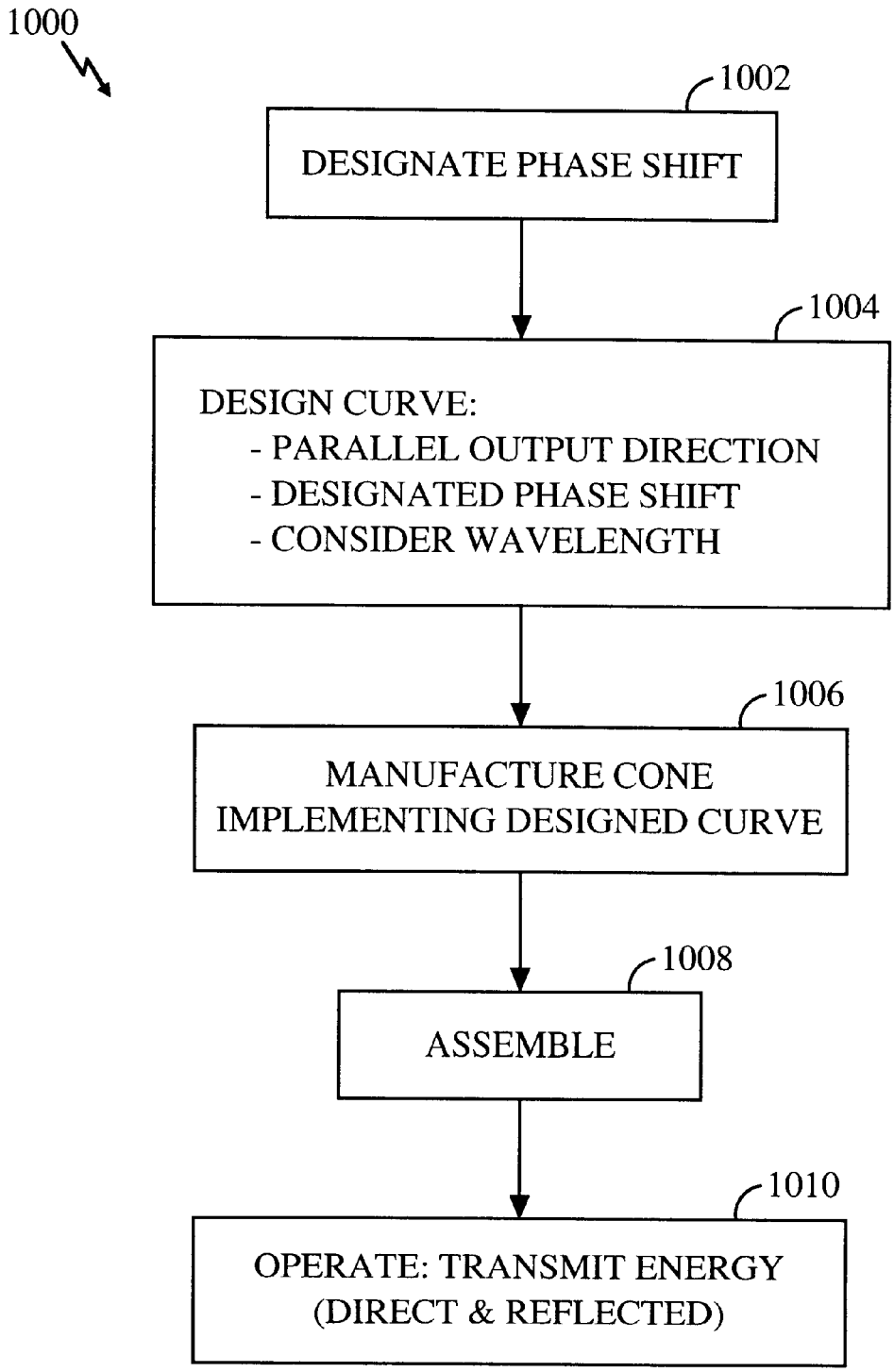
FIG. 10 is a flowchart of an operational sequence for manufacturing and operating a signal reflector according to the invention.

FIG. 10 shows a sequence 1000 that illustrates one example of the method aspect of the present invention. For ease of explanation, but without any intended limitation, the example of FIG. 10 is described in the context of the structure of FIG. 9. The sequence is initiated in step 1002, where the reflector's phase shift characteristic is established. This occurs by input from a customer, requirements of the application, engineering considerations, or other source of data. In the present example, the designated phase shift is 360 degrees.

Next, in step 1004, engineers or other design personnel design a concave curve (such as an exact or near paraboloid that is symmetrical about an axis), shaped to reflect any energy arriving from a vertex of the curve into a direction substantially parallel to the axis. The design is also conducted so that the curve provides all reflected signals with a designated phase shift relative to unreflected energy from the vertex of the curve, the phase shift being uniform regardless of where the received energy contacts the reflector. In the present example (with a phase shift of 360 degrees), the distance 930 is chosen to be equal to the distance 932 plus one wavelength (or two, three, four, or another integer multiple) of the periodic source signal. Thus, the reference ray 950 at point 920 is exactly one cycle out of phase with the incident ray 952. As the rays 950, 952 propagate in parallel from the points 920, 921, they will remain in phase. In designing the reflector to implement the designated phase shift, as further explained below, the expected signal's wavelength is necessarily taken into account.

As one example, the reflector's shape may be defined using the relationship shown in Equation 2, below. The relationship of Equation 2 describes the shape of the reflector's interior surface.

$$y=(x^2/2k\lambda)-k\lambda/2 \qquad \text{[Eq. 2]}$$

where:

- y=vertical distance 932, for example, the distance in the vertical direction 980 from the center of horn 403 of the piezoelectric sound transducer 103 (FIG. 4).
- x=distance 931, for example, the distance in the horizontal direction 970 from the center of horn 403 of the piezoelectric sound transducer 103 (FIG. 4).
- λ=wavelength of the transmitted signal energy.
- k=a phase shift constant, describing the implemented phase shift (for the current λ) in 360 degree increments. For example, phase shift is 360 degrees when k=1, 540 degrees when k=1.5, etc.

As mentioned above, the expected signal's wavelength is necessarily taken into account. This may infer a certain temperature, since signal wavelength may change over temperature due to temperature dependent characteristics of the signal generating element. Therefore, a particular temperature is inherent to Equation 2 (above). If ambient temperature is expected to vary, the reflector may be designed according to an average, mean, or other combination of the expected wavelengths. As a particular example, Equation 2 may be used to initially determine a tentative reflector shape for a particular wavelength. Then, this tentative reflector shape is reevaluated for other expected temperatures by re-solving Equation 2 for k using the x and y values of the tentative reflector shape and the new wavelengths expected for the other expected temperatures. Resolving this equation provides the resulting k values for other temperatures, which can be scrutinized for whether their phase shift diverges too much from the desired phase shift. This reevaluation may also be performed by empirical testing, instead, rather than mathematical analysis. With this information, a choice may be made to change the initial value of k (giving a different phase shift for the original wavelength) to better accommodate the other expected wavelengths. As another way to view this procedure, the reflector may be designed by solving Equation 2 for a different wavelength than the initial wavelength, which more accurately represents the range of expected wavelengths. With this method, the reflector shape is effectively tuned for a particular range of expected wavelengths.

The following illustrates one example of the consideration of wavelength in establishing the difference between lengths 930–932 (FIG. 9). For greater clarity of illustration, round numbers are used, and other mathematical aspects simplified. In this example, the wavelength is 0.01385 meters (corresponding to a 25 KHz signal frequency, in air, at 25° C.), and the designated phase shift is 360 degrees. Here, regardless of the direction of any ray 922, Equation 2 defines a reflective surface which guarantees that the reflected direction (for ray 952) will be parallel to reference ray 950. Further, as long as k in Equation 2 is an integer, the surface so defined also guarantees that the distance 930 traveled by any ray 922 will be longer than distance 932 by exactly the same integer multiple of the source signal's wavelength, in this case a multiple of 0.01385 meters. Consequently, any ray 952, from its inception at point 921, will be exactly in phase with ray 950, starting at the corresponding point 920.

One technique for implementing this relationship is presented above in Equation 2. Using this technique, the (x, y) coordinates of the interior surface of the reflector are described by Equations 3–4, shown below.

$$y=(x^2/2*1*0.01385)-1*0.01385/2 \quad \text{[Eq. 3]}$$

$$y=x^2*36.101-0.006925 \quad \text{[Eq. 4]}$$

Referring again to FIG. 10, step 1006 is performed after step 1004. In step 1006, a reflector (also called a reflecting "cone") is manufactured so as to implement the design specifications of step 1004. In one example, step 1004 specifies a two-dimensional curve meeting the design requirements, and step 1006 manufactures a three-dimensional reflector whose cross-sectional shape matches this curve. The manufacture of the reflector may be conducted using vacuum molding, press molding, cutting, extruding, or any other beneficial technique.

In step 1008, technicians or automated equipment complete the manufacture of a focused beam generator (such as 100 of FIG. 1) utilizing the reflector produced in step 1006. This step involves attaching the reflector to a premanufactured signal source using adhesive, one or more mechanical connectors, press fitting, or other means.

In step 1010, the completed focused beam generator is operated. In one example, this step 1010 is performed right away to test the beam generator. Alternatively (or additionally), step 1010 may be performed after some delay (not shown), such as when the customer later uses the beam generator for its intended application. The details of step 1010 are as follows. First, the test engineer, customer, or other operator supplies a sinusoidal, square wave, triangular wave, or other periodic electrical waveform to the signal source's electrical leads 106–107 (FIG. 1). This waveform is referred to as the input waveform. Next, the signal source reacts to the input waveform by transmitting energy in various directions. Some of this energy proceeds from the signal source to directly exit the reflector, namely energy within the angular range 802 (FIG. 8). Other energy from the signal source contacts the reflector at various points, namely energy emanating from the signal source outside the limits 804–805. Due to the shape of the parabolic reflector, all rays from the signal source that contact the reflector are redirected into a common direction (as shown by 703, FIG. 7) regardless of where they contact the reflector. Moreover, all reflected signals achieve a designated constant phase shift relative to energy directly exiting the reflector, regardless of the point of contact with the reflector. This is because the distance between the signal source and each possible point of signal reflection has a specific relationship to the "y" direction 980 distance between that point and the signal source. For example, the distance 930 between signal source 810 and reflection point 921 has a fixed relationship with the "y" direction 980 distance between the transducer and the point 921.

In cases where the reflector is designed to introduce a phase shift of 360 degrees, there are particular benefits for some applications. Namely, for periodic source signals, the delay of one complete cycle places the incident rays in precisely the same phase as the reference rays, minimizing any near field signal interference between the signals. This can be especially beneficial in acoustic applications, where transmitted energy incident at any angle greater than angle 802 tends to combine additively in the far field with energy emanating from within the limits 804–805. This process focuses most of the available energy toward the center of the transmission pattern. Phase shift of 360 degrees is achieved by designing the reflector so that the difference between distance 930 and distance 932 is an integer multiple of the wavelength of the source signal.

OTHER EMBODIMENTS

While the foregoing disclosure shows a number of illustrative embodiments of the invention, it will be apparent to those skilled in the art that various changes and modifications can be made herein without departing from the scope of the invention as defined by the appended claims. Furthermore, although elements of the invention may be described or claimed in the singular, the plural is contemplated unless limitation to the singular is explicitly stated. Additionally, ordinarily skilled artisans will recognize that operational sequences must be set forth in some specific order for the purpose of explanation and claiming, but the present invention contemplates various changes beyond such specific order.

What is claimed is:

1. An apparatus for redirecting output energy transmitted by a signal source, the apparatus comprising a concave reflector with an interior surface dimensioned to receive some energy of predefined properties radiating from a signal source positioned substantially at a vertex of the reflector and to reflect all received energy in a predefined uniform output direction, the surface being additionally dimensioned to introduce a designated phase shift into all reflected energy relative to unreflected energy from the signal source, the designated phase shift being constant regardless of where the received energy is received upon the reflector.

2. The reflector of claim 1, further comprising the signal source.

3. The reflector of claim 1, the interior surface of the reflector having a substantially paraboloid shape.

4. The reflector of claim 1, where the predefined properties of the energy include one or more designated wavelengths.

5. The reflector of claim 1, where the interior surface of the reflector is dimensioned to approximate the designated phase shift over a range of expected wavelengths of energy.

6. The reflector of claim 1, where the interior surface of the reflector is dimensioned to approximate the designated phase shift over a range of expected ambient temperatures.

7. An apparatus for redirecting output energy transmitted by a signal source, the apparatus comprising a concave reflector whose cross-sectional shape comprises a substantially parabolic curve dimensioned to reflect signals from a vertex of the curve into a direction substantially parallel with an axis of the curve, the curve being also dimensioned to introduce a designated phase shift into all reflected energy relative to unreflected energy emanating from the vertex, the designated phase shift being constant regardless of where the received energy is received upon the curve.

8. The apparatus of claim 7, further comprising the signal source.

9. The apparatus of claim 7, where the curve is dimensioned to introduce a designated phase shift into reflected energy of one or more designated wavelengths.

10. A signal reflector product manufactured by a process comprising operations of:

receiving designation of a phase shift;

designing an arc having a predetermnined axis, where the arc is dimensioned to reflect any signals arriving from a vertex of the arc into a direction substantially parallel to the axis, and also shaped to provide reflected signals with the designated phase shift relative to unreflected signals from the vertex of the arc regardless of where the received signals contact the arc; and producing a concave reflector whose cross-sectional shape exhibits the designated arc.

11. The product of claim 10, where the designing operation is conducted such that the arc is dimensioned to approximate the designated phase shift for reflected signals of one or more designated wavelengths.

12. A method of manufacturing a signal reflector, comprising:

receiving designation of a phase shift;

designing a substantially symmetrical arc having a predetermined axis, where the arc is shaped to reflect energy arriving from a vertex of the arc into a direction substantially parallel to the axis, and also shaped to provide reflected signals with a designated constant phase shift relative to unreflected energy emanating from the vertex of the arc regardless of where the received energy contacts the arc;

producing a generally cone-shaped reflector having an interior surface whose cross-sectional shape exhibits the designed arc.

13. The method of claim 12, the operation of designing the arc comprising:

designing the arc with dimensions to approximate the designated phase shift for reflected energy of one or more designated wavelengths.

14. The method of claim 12, the operation of designing the arc comprising:

designing the arc with dimensions to approximate the designated phase shift over a range of ambient temperatures.

15. A method of providing a focused output beam, comprising operations of:

transmitting energy from an energy source positioned proximate an inner surface of a concave reflector;

energy emanating from the signal source in various directions;

some of the energy proceeding from the signal source to directly exit the reflector;

other of the energy proceeding from the energy source in various directions to contact the reflector at various points, and due to shape of the reflector, this energy being redirected into a uniform direction and experiencing a uniform constant phase shift relative to energy directly exiting the reflector.

16. A method of providing an output beam, comprising operations of:

transmitting energy from a signal source positioned proximate an inner surface of a parabolic reflector;

energy emanating from the signal source in a multiplicity of rays of different directions;

some of the rays directly exit the reflector from the signal source;

other of the rays proceeding from the energy source in various directions to contact the inner surface at various points, and due to shape of the inner surface, the rays being redirected into a common direction and achieving a designated constant phase shift relative to rays directly exiting the reflector.

* * * * *